United States Patent [19]

Kemp

[11] 4,175,739

[45] Nov. 27, 1979

[54] PAPER COLLATING MACHINES

[75] Inventor: Jack V. L. Kemp, Dunstable, England

[73] Assignee: Kemp Applications Sales Limited, New Malden, England

[21] Appl. No.: 918,187

[22] Filed: Jun. 22, 1978

[30] Foreign Application Priority Data

Jul. 21, 1977 [GB] United Kingdom ..... 30697/77

[51] Int. Cl.[2] ..... B65H 39/05

[52] U.S. Cl. ..... 270/58

[58] Field of Search ..... 270/58–59

[56] References Cited

U.S. PATENT DOCUMENTS

| | | | |
|---|---|---|---|
| 2,624,571 | 1/1953 | Dixon | 270/58 |
| 3,559,982 | 2/1971 | Eppers | 270/58 |

FOREIGN PATENT DOCUMENTS

| | | | |
|---|---|---|---|
| 1093099 | 11/1967 | United Kingdom | 270/58 |

*Primary Examiner*—Edgar S. Burr
*Assistant Examiner*—A. Heinz
*Attorney, Agent, or Firm*—Sughrue, Rothwell, Mion, Zinn and Macpeak

[57] ABSTRACT

A paper collating machine of the kind comprising a plurality of paper holders mounted one above the other or in a row and each arranged to hold a stack of rectangular sheets of paper, and a mechanism for feeding the top sheet from the stack in each holder with one edge of each sheet leading, has the paper holders mounted so that they are inclined laterally across the direction in which the sheets of paper are fed by the feed mechanism and each holder has, at its lower side edge, a supporting surface which, in use, is engaged by and supports one side edge of the stack. The side edges of the sheets slide along the supporting surfaces as the sheets are fed and all of the supporting surfaces lie in a common plane so that the sheets from all of the stacks are laterally aligned with each other as they are fed by the feed mechanism. Preferably the supporting surfaces extend from the holders in the common plane in the direction in which the sheets are fed and so form a guide for all the sheets as they are fed by the feed mechanism. All of the supporting surfaces may be formed by a single flat wall which is inclined to the vertical and they are preferably made of a material which has a high coefficient of friction with the paper.

12 Claims, 8 Drawing Figures

PAPER COLLATING MACHINES

There are various existing forms of paper collating machines which comprise a plurality of paper holders mounted one above the other or in a row and each arranged to hold a stack of rectangular sheets of paper, and a paper feed mechanism for feeding the top sheet from the stack in each holder with one edge of each sheet leading. The sheets fed from all of the stacks are then gathered into a set.

One of the main difficulties which occurs with such collating machines is that the feed mechanism by which the sheets are fed from the tops of the stacks tends from time to time to feed more than one sheet from the top of one stack at one time. Various expedients have been adopted to overcome this problem of double feeding, for instance, in one form of machine, the holders are arranged in a row and are steeply inclined. The sheets are fed upwards from the holders so that gravity acts to hold back the second and remaining sheets in each stack as the top sheet from each stack is fed upwards. The success of this arrangement is, however, very much dependent upon the quality, and accordingly the surface finish, of the paper which is being collated.

The aim of the present invention is to overcome the problem of double feeding and, to this end, according to this invention, in a paper collating machine comprising a plurality of paper holders mounted one above the other or in a row and each arranged to hold a stack of rectangular sheets of paper, and a mechanism for feeding the top sheet from the stack in each holder with one edge of each sheet leading, the paper holders are inclined laterally across the direction in which the sheets are fed by the feed mechanism and each holder has, at its lower side edge, a supporting surface, which, in use, is engaged by and supports one side edge of the stack and along which the side edges of the sheets slide as the sheets are fed, all the supporting surfaces lying in a common plane so that the sheets from all of the stacks are laterally aligned with each other as they are fed by the feed mechanism.

The angle of lateral inclination of the holders may vary over wide limits depending upon the nature of the paper. An inclination from the vertical of from 20° to 70° is however preferred.

With the paper holders laterally inclined, as the top sheet in each stack is fed by the feed mechanism, the second and subsequent sheets in each stack are held back not only by the friction between these sheets and the sheets below, but also by the frictional force acting between these sheets and the supporting surface at the side of the holder. It has been found very surprisingly that the quite small added frictional force on the side edge of the second and lower sheets in each stack is remarkably effective in decreasing the risk of double feeding.

The frictional force acting on the side edges of the sheets may be increased by forming the supporting surface of a material which has a high coefficient of friction with the paper, for example rubber or abrasive material such as emery or carborundum.

Preferably the supporting surfaces extend from the holders in the common plane in the feeding direction to form a guide for all the sheets as they are fed by the feed mechanism. This arrangement has the added advantage that all of the sheets are kept in lateral alignment as they are fed forward for gathering into a set because, owing to the action of gravity which is induced by the lateral inclination of the paper holders, the sheets continue to slide with their side edges in contact with the supporting surfaces as they are fed forwards by the feed mechanism. This greatly facilitates the gathering of the stream of sheets from the individual stacks neatly into a set in which all the sheets are in register with each other both in the feeding direction and in a direction transverse to the feeding direction.

The holders, which may be in the form of trays, may be horizontal in the feeding direction or they may be upwardly inclined in the feeding direction so that a component of a gravitational force also acts in helping to hold back the second and subsequent lower sheets of each stack as the top sheet of the stack is fed forwards by the feed mechanism.

The feed mechanism may be either power-operated or be manually operated. In either case, the arrangement in accordance with the invention may lead to an extremely simple construction of the holders in which the supporting surfaces are all formed by a single flat wall which is inclined to the vertical and each of the holders comprises a tray fixed to and projecting at right angles from one face of the wall. The wall is thus, of course, inclined to the vertical at the same angle as the paper holders are laterally inclined to the horizontal.

To facilitate the placing of the stacks of paper sheets in the holders in a neat manner with all the sheets in register with each other, each holder is preferably also provided with a further support surface for supporting the trailing edge of the stack of sheets of paper. When this is done, the stack of sheets in each holder is supported at the bottom, at the trailing or rear edge, and also along one side edge so that the possibility of the papers in the stacks becoming disarranged during the course of feeding of the sheets from the stacks is very remote.

Preferably a funnel-like guide is provided adjacent the holders on the side of the holders to which the sheets are fed by the feed mechanism. This guide is preferably arranged so that it directs the sheets fed from the various holders towards a plane at or near the centre of the height of the holders, which are arranged one above the other and then directs the sheets through a narrow slot through which this centre plane passes. Thus the funnel-like guide directs the sheets from the upper holders downwards towards the centre plane and the sheets from the lower holders upwards towards the centre plane so that all the sheets are in contact with each other and already form a set as they pass through the slot.

When the sheets fed from the holders are caused to converge in this way by a funnel-like guide, the sheets from the uppermost and lowermost holders have to travel further to the slot than the sheets from a centre holder. To ensure accurate register of the leading edges of the sheets under these circumstances, a stop is preferably provided on the outlet side of the funnel-like guide and, in operation, the sheets from all the holders are fed by the feed mechanism against the stop. Since the side edges of the sheets are held in alignment by the supporting surfaces in the common plane as already explained, when the sheets come up against the stop, they are all in register with each other in two directions at right angles. A stapling machine may then be incorporated in the collating machine and this stapling machine may be actuated to staple the set of sheets together as soon as they have all come up against the stop so that they are all then held as a set of registering sheets. The stapling machine may be separately operated or it may be coupled to the feed mechanism so that when the feed mechanism has fed all the sheets against the stop, the stapling machine is then automatically operated.

When it is required to feed a set of sheets onwards from the collating machine, for example to a machine for folding the sets of sheets or into a collecting tray, the stop may be formed by the nip between a pair of take-away rollers. The rollers having a driving mechanism by which, in operation, they are held stationary as the sheets are fed against the nip by the feed mechanism; are subsequently rotated through a part of a turn to grip the leading edges of the sheets while the sheets are still being fed by the feed mechanism and are then rotated to feed the sheets between the rollers while the feed mechanism is returning to a starting position ready to feed the next set of papers.

In order to reduce the risk of double feeding of the sheets from the stacks still further, pressure means may be provided at the side of each of the holders remote from the supporting surface. The pressure means is adapted to exert pressure on the edges of the upper sheets of paper in the stack in the holder to urge these sheets against the supporting surface. In this way the frictional drag exerted on the sheets by the supporting surface is increased and a further drag is exerted on the sheets by the pressure means itself.

The pressure means may comprise a knife edge which extends substantially perpendicular to the direction in which the sheets are fed by the feed mechanism and is biased towards the supporting surface. The knife edge is angled to the common plane so that it engages only with the top corner of the stack of sheets in the holder, that is with only a few of the uppermost sheets of the stack.

Some examples of collating machines constructed in accordance with the invention will now be described with reference to the accompanying somewhat diagrammatic drawings, in which.

Figure 1:
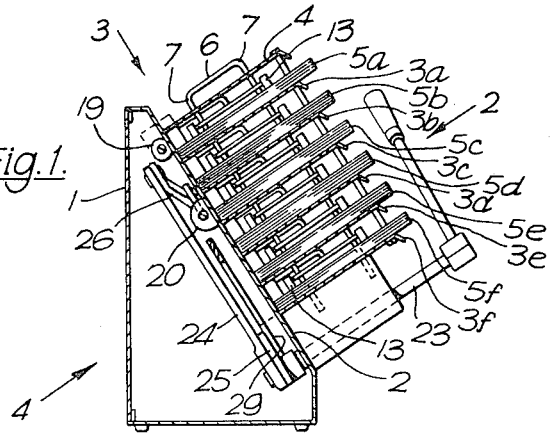
FIG. 1 is a section of one example as seen in the direction of the arrows on the line 1—1 in FIG. 2.

The first example shown in FIGS. 1 to 4, comprises a housing 1 having a flat side wall 2 which is inclined at an angle of approximately 30 degrees to the vertical. A plurality of sheet metal trays 3*a* to 3*f* are fixed to and project at right angles from the wall 2 and each of the trays 3*a* to 3*f* forms a paper holder. Above the uppermost tray 3*a* is a sheet metal plate 4 which forms a cover over the trays. As shown in the drawings, each of the trays 3*a* to 3*f* supports a stack of rectangular paper sheets 5*a* to 5*f* respectively. The left-hand side of the sheets in each of the stacks 5*a* to 5*f* rests against the wall 2 which forms a supporting surface for the side of each of the stacks and, since the wall 2 is flat, all these supporting surfaces lie in a common plane. Since the trays 3*a* to 3*f* lie at right angles to the wall 2, they are laterally inclined at approximately 30 degrees to the horizontal so that there is a gravitational force holding the sheets of paper in the stacks 5*a* to 5*f* against the wall 2. To increase the friction between the side edges of the sheets in the stacks 5*a* to 5*f* and the wall 2, the right-hand face of the wall 2, as seen in FIG. 1, may be covered with a thin sheet of rubber or of abrasive material such as carborundum paper.

Figure 2:
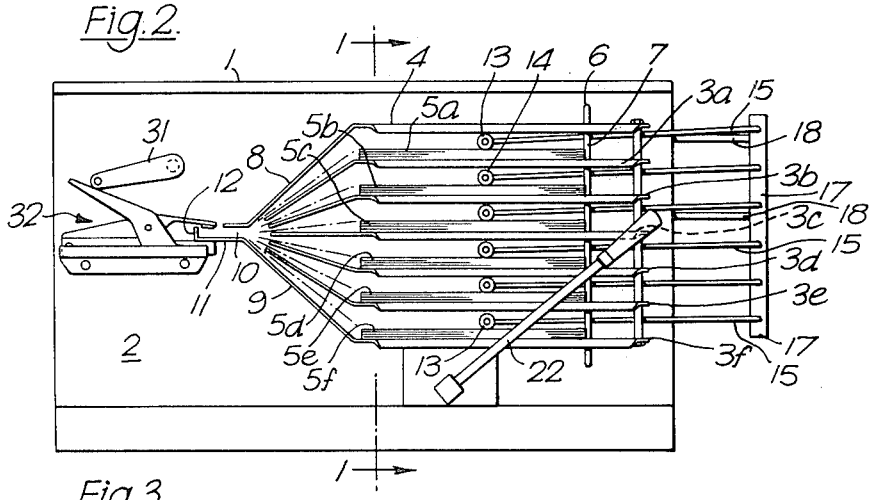
FIG. 2 is an elevation of the first example as seen in the direction of the arrow 2 in FIG. 1.

A U-shaped rod 6 has its side arms 7 extending through aligned holes in the trays 3*a* to 3*f* and this rod thus forms a further support surface which holds the rear edges of the stacks of paper 5*a* to 5*f*, that is the right-hand edges as seen in FIG. 2, in alignment with each other.

The left-hand end of the cover plate 4 has a downwardly extending portion 8 and the lowermost tray 3*f* has an upwardly extending portion 9 which, together with the portion 8 forms a funnel-shaped guide. The funnel-shaped guide terminates in a slot 10 at the same level as the tray 5*c* and the trays 5*a* to 5*e* all have portions which, as shown in FIG. 2, are directed towards the slot 10. The portion 9 has at its left-hand end a horizontal plate 11 terminating in an upwardly projecting portion which forms a stop 12.

A paper feed mechanism comprises a pair of rubber feed pads 13 for each of the trays 5*a* to 5*f*. Each pair of feed pads 13 is mounted on a bar 14. Each of the bars 14 is fixed to an L-shaped feed rod 15, one arm 16 of which is pivotally mounted in aligned holes in a channel-shaped member 17. The channel-shaped member 17 is supported by two guide rods 18 which are fixed to the member 17 and are slidable in guide members 19, 20 and 21 are shown in FIG. 4.

Figure 3:
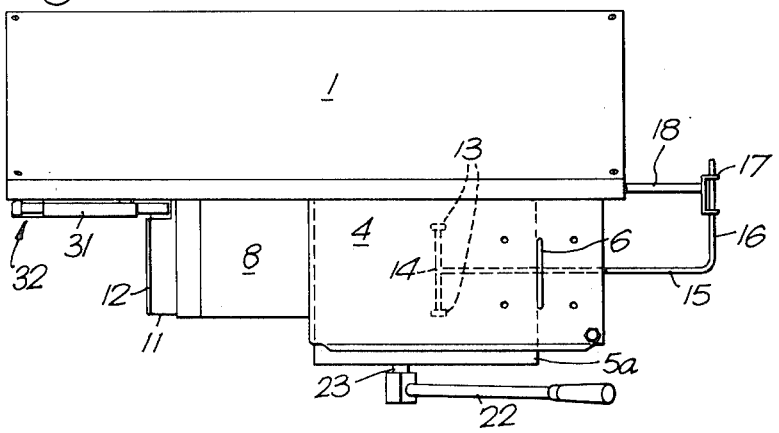
FIG. 3 is a plan of the first example as seen in the direction of the arrow 3 in FIG. 1.

The feed rods 15 are reciprocable from left to right as seen in FIGS. 2 and 3 by reciprocation of the member 17 which is in turn brought about by reciprocation of the rods 18.

The reciprocation of the rods 18 is brought about manually by rocking a lever 22 in a counter-clockwise direction as seen in FIG. 2. The lever 22 is fixed to a shaft 23 which in turn has levers 24 and 25 fixed to it as shown in FIGS. 1 and 4.

Figure 4:
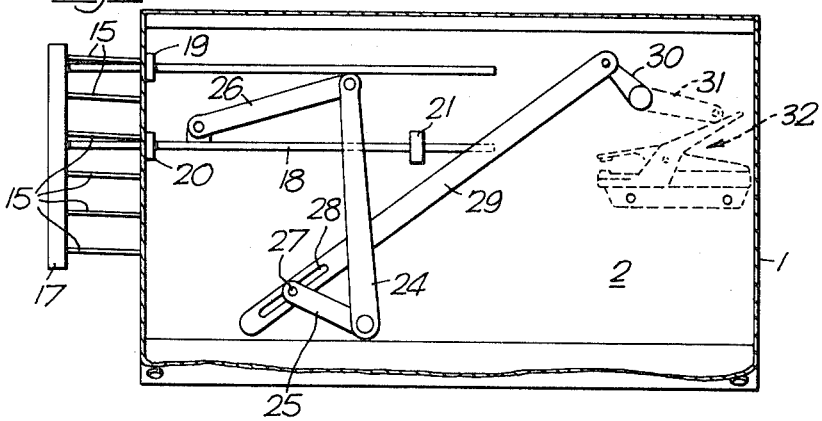
FIG. 4 is a view of the first example as seen in the direction of the arrow 4 in FIG. 1 with part of an outer casing removed to show internal details.

Rocking of the lever 22 rocks the lever 24, which forms a crank, through a similar angle and rocking of the lever 24 in a clockwise direction moves a connecting rod 26, which is extensible against the action of a spring, and the rod 25 in turn moves the lower of the two guide rods 18 and with it the feed rods 15 towards the right as seen in FIG. 4, that is towards the left as seen in FIG. 3. The extent of this movement is limited by the member 17 coming into engagement with the housing 1.

The lever 25 is connected through a pin 27 and a slot 28, which together form a lost-motion connection, to a connecting rod 29 which is pivotally attached to a crank 30. The crank 30, which is shown in FIG. 4, is directly connected to a further crank 31 shown most clearly in FIG. 2. The pin 27 reaches the right-hand end of the slot 28 at the end of the feed movement of the member 17 when the member 17 engages the housing 1, but further rotation of the levers 24 and 25 is permitted by extension of the rod 26 against the action of its spring. The further rotation of the lever 25 moves the connecting rod 28 and this rotates the crank 31 clockwise as seen in FIG. 4 and counter-clockwise as seen in FIG. 2.

The crank 31 actuates a stapling device 32 which is fixed to the wall 2 adjacent the stop 12. Owing to the lost-motion connection formed by the pin and slot 27 and 28 and the extensibility of the connecting rod 26, actuation of the stapling device 32 only occurs after the feed pads 13 have reached the limit of their movement towards the left as seen in FIG. 2.

To operate the machine shown in FIGS. 1 to 4 of the drawings, the stacks of paper 5*a* to 5*f* are placed on the trays 3*a* to 3*f* as already described with the pairs of feed pads 13 resting with one pair in contact with the top sheet of each of the stacks. The lever 22 is then rocked manually in a counter-clockwise direction as seen in FIG. 2 and this causes the feed pads 13 to be moved to the left as already described and they grip the top sheet of paper in each of the stacks 5*a* to 5*f* and feed the sheets through the funnel-shaped guide as indicated in chain-dotted lines in FIG. 2 and the funnel-shaped guide 8, 9 together with the portions extending from the trays 3*a* to 3*f* within the guide, cause the top sheets of paper in each of the stacks to be fed through the slot 10 up against the stop 12. The sheets of paper come into engagement with the stop 12 just before the member 17 has come into engagement with the housing 1. Continued movement of the member 17 causes the pads 13 to buckle the sheets slightly against the stop 12 and this ensures that all the sheets are pressed against the stop. After this further movement of the lever 22 moves the crank 31 to operate the stapling device and staple the set of sheets, one from each of the stacks 3*a* to 3*f* together.

During the whole of the movement of the sheets from the tops of the stacks 3*a* to 3*f*, these sheets are held by gravity against the face of the wall 2 so that the sheets are held in lateral alignment with each other and they are brought into register with each other in their direction of movement by the stop 12. All the sheets are therefore accurately superimposed upon each other at the time that they are stapled together.

At the end of this operation the stapled set of sheets of paper can be withdrawn manually from the side of the funnel-shaped guide remote from the wall 2 and at the same time the lever 22 is swung manually back into its starting position shown in FIG. 2 of the drawings. During this movement, the feed pads 13 slide back over the top surfaces of the top sheets of paper in the stacks 5*a* to 5*f*. The machine is then ready for a further cycle of operations.

During the feeding of the top sheets from each of the stacks 5*a* to 5*f* by the feed rollers 13, the sheet below the top sheet in each of the stacks is prevented or inhibited from any movement towards the left by the frictional force applied to it by the moving top sheet by the frictional force between this sheet and the sheets below it and the frictional force between the side edge of the sheet and the wall 2, which as already described, may be covered with rubber or abrasive material such as carborundum paper.

Figure 5:
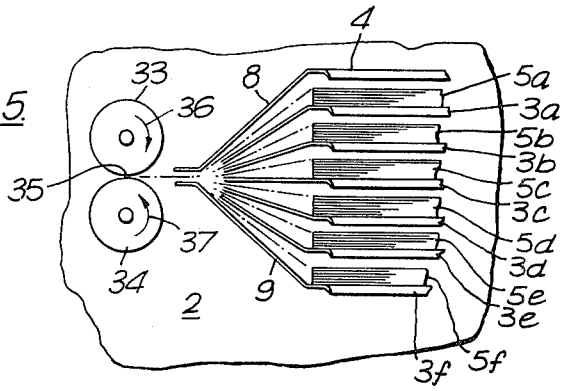
FIG. 5 is a fragmentary view in the direction of the arrow 2 in FIG. 1, but showing a modification of the first example.

In the modification shown in FIG. 5 of the drawings, the stapling device 32 and the stop 12 are replaced by a pair of take-away rollers 33 and 34. In operation of the machine, the rollers 33 and 34 are rotated through linkages and gearing which are not shown by movement of the lever 22 in a manner somewhat similar to that in which the stapling device 32 is actuated. The linkages and gearing connecting the shaft 23 of the lever 22 to the rollers 33 and 34 are not shown, but incorporate lost-motion connections similar to the pin and slot connection 27, 28 such that when the lever 22 is swung in a counter-clockwise direction as seen in FIG. 2, first of all the rollers 33 and 34 are held stationary so that the sheets from the stacks 5*a* to 5*f* are fed against the nip 35, which is formed between the rollers 33 and 34 and forms a stop. The last part of the rotation of the lever 22 in a counter-clockwise direction, which in the example of FIGS. 1 to 4 actuates the stapling device 32, causes the rollers 33 and 34 to rotate through a small angle in the direction of the arrows 36 and 37 respectively. This causes the rollers 33 and 34 to grip the leading edges of the set of sheets between them after the sheets have been brought into register with each other by being fed into the nip 35 whilst the rollers 33 and 34 were stationary. The return movement of the lever 22 in a clockwise direction as seen in FIG. 2 causes the rollers to continue to rotate at higher speed and through a number of revolutions in the directions of the arrows 36 and 37 so that the set of papers with all the sheets in register with each other are fed between the rollers 33 and 34 to, for example, a further machine for folding the sheets or feeding the sets of sheets into a collecting tray or bin.

Figure 6:
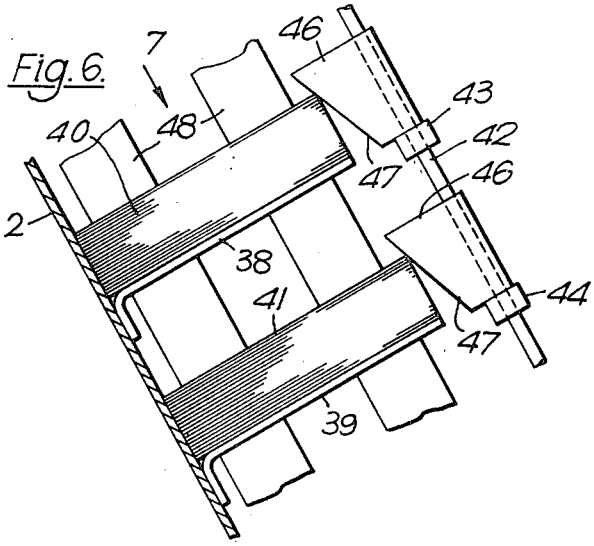
FIG. 6 is a fragmentary front view of the first example, but showing a further modification.
Figure 7:
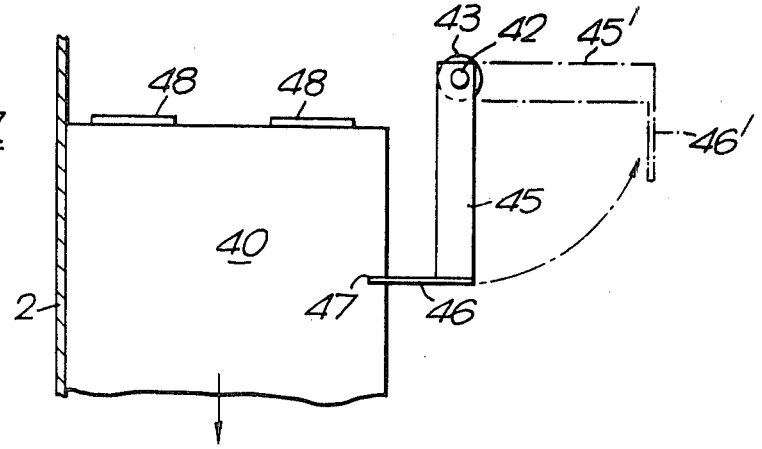
FIG. 7 is a plan view as seen in the direction of the arrow 7 in FIG. 6.

In the further modification shown in FIGS. 6 and 7, each of the trays, two of which are shown at 38 and 39 and which project at right angles from the wall 2 is of the same width as the stacks 40 and 41 of sheets of paper which are carried by the trays 38 and 39 respectively. Thus the stacks of paper are fully supported at their right-hand edges as seen in FIG. 6.

A spindle 42 is fixed parallel to the wall 2 and has a series of collars, one for each of the trays and two of which are shown at 43 and 44, fixed to it. Each of the collars 43 or 44 supports an arm 45, as shown in FIG. 7, and these arms are each rotatably mounted at one end on the spindle 42 and carry at the other end a blade 46 having a knife edge 47. When the blades 46 are in the full-line position as shown in FIG. 7, they lie substantially perpendicular to the direction in which the sheets are fed by the feed rollers 13, that is away from supports 48 for the rear edges of the stacks 40 and 41 and each knife edge 47 is angled to the common plane formed by the face of the wall 2. The knife edges 47 are biased gravitationally into engagement with the upper sheets of the stack so that the knife edge forms a nick in these sheets to hold the undersheets back as each top sheet is fed forwards by the feed rollers 13 and the biasing force also applies pressure to press the upper sheets in the stack against the support surface formed by the wall 2.

The arms 45 together with the blades 46 can by swung out on the spindle 42 from the full-line position to the chain-dotted line position as shown in FIG. 7 at 45', 46'. This is to provide clear access to the trays 38 and 39 to enable them to be re-loaded with paper when required.

Figure 8:
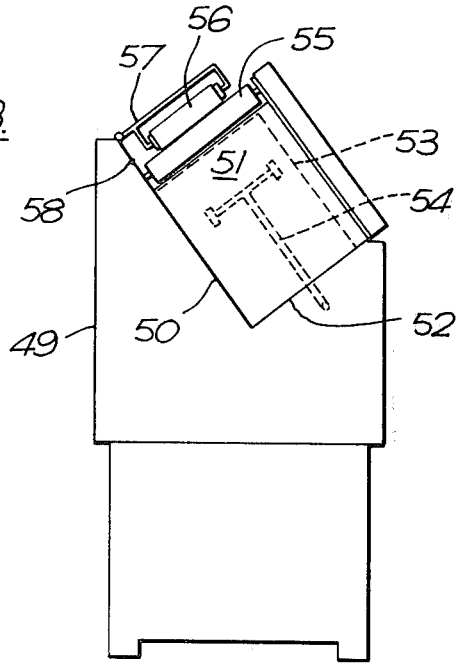
FIG. 8 is a front elevation of a second example.

The second example shown highly diagrammatically in FIG. 8 is entirely power-operated. It comprises a housing 49 having an inclined wall 50 which forms a series of supporting surfaces in a common plane in the same way as the wall 2 of the first example. A series of paper holders are formed by inclined plates one of which is shown at 51 and which are mounted between the inclined wall 50 and a plate 52 of the housing.

Each of the plates 51 is upwardly and forwardly inclined from the plane of the paper as seen in FIG. 8 and forms a holder for a stack of sheets of paper 53. As in conventional machines, the top sheet in each of the stacks 53 is fed upwards by a movable power-driven feed arm 54 and as the sheet protrudes from the top of the stack 53, it is seized in the nip between a power-driven rotating feed roller 55 and the lower flight of an endless belt 56 which extends across the tops of all of the plates 51 and the stacks 53 and is supported at intervals on rollers carried by brackets 57. The belt 56 and the rollers 55 between them feed forwards from the plane of the paper as seen in FIG. 8 an overlapping stream of sheets of paper. The mechanism by which this is achieved, is not illustrated because it is entirely conventional, but in the conventional machines the side edges of the plates 51 are upright and the plate 52 is horizontal so that the stacks of paper 53 are inclined only forwardly in the feed direction and are vertical in a lateral direction. In the second example, however, the holders are laterally inclined and the wall 50 forms a supporting surface for the stack of sheets of paper in each holder and the sheets of paper are fed forwards by the rollers 55 and the belt 56 with their side edges in contact with an upper portion 58 of the wall 50.

The laterally inclined wall 50 acts in the same way as the wall 2 in the first example to assist in holding back all the sheets in each stack except the uppermost sheet as the uppermost sheet is fed upwards by the feed arm 54 and the wall 50 also acts to guide the sheets laterally as they are fed forwards by the rollers 55 and the belt 56.

I claim:

1. In a paper collating machine comprising a plurality of paper holders, each of which is adapted to hold a stack of rectangular sheets of paper, means mounting said paper holders in a row, and means for feeding the top sheet from the stack of sheets of paper in each holder in a predetermined direction with one edge of each sheet leading, the improvement wherein said means mounting said paper holders supports said paper holders in a position inclined transverse to said predetermined direction, means defining a lower side edge of each holder, means defining a supporting surface at said lower side edge of each of said holders parallel to said predetermined direction, said supporting surface, in use, being operative to engage and support one side edge of said stack in said holder and said mechanism being operative to feed said sheets slidingly along said supporting surfaces, and all of said supporting surfaces lying in a common plane whereby said sheets from all of said stacks are laterally aligned with each other as they are fed in said predetermined direction by said feed mechanism.

2. A machine as claimed in claim 1, wherein each of said supporting surfaces is of a material which has a high coefficient of friction with said side edges of said sheets of paper.

3. A machine as claimed in claim 2, wherein said supporting surface is of rubber.

4. A machine as claimed in claim 2, wherein said supporting surface is of abrasive material.

5. A machine as claimed in claim 1, wherein said supporting surfaces project beyond said holders in said common plane and in said predetermined direction whereby said supporting surfaces define a guide for all of said sheets as said sheets are fed by said feed mechanism.

6. A machine as claimed in claim 1, wherein said means defining said supporting surfaces comprises a single flat wall, and means supporting said single flat wall at an inclination to the vertical, and each of said holders comprises a tray and means fixing said tray to said single flat wall with said tray projecting at right angles from said wall.

7. A machine as claimed in claim 1, in which each of said holders further comprises means defining a further support surface perpendicular to said supporting surface at said lower side edge, said further support surface being adapted to support the trailing edges of said sheets of paper of said stack.

8. A machine as claimed in claim 1, further comprising funnel-like sheet guide means, and means supporting said funnel-like sheet guide means adjacent said holders and spaced from said holders in said predetermined direction, whereby said sheets are fed by said feed mechanism through said funnel-like sheet guide.

9. A machine as claimed in claim 8, further comprising stop means, and means mounting said stop means spaced from said funnel-like guide in said predetermined direction, whereby said feed mechanism feeds said sheet from all of said holders through said funnel-like guide against said stop.

10. A machine as claimed in claim 9, further comprising a pair of rollers, means rotatably mounting said pair of rollers to form a nip between said rollers, said nip forming said stop, and a driving mechanism for rotating said rollers, said driving mechanism being operative to hold said rollers stationary as said sheets are fed against said nip by said feed mechanism, subsequently to rotate said rollers through a part of a turn to grip leading edges of said sheets while said sheets are still being fed by said feed mechanism and then to rotate said rollers to feed said sheets through said nip between said rollers while said feed mechanism is returning to a starting position.

11. A machine as claimed in claim 1, further comprising a plurality of pressure means and means mounting said pressure means one at the edge of each of said holders opposite from said lower side edge, said pressure means being operative to exert pressure on the edges of upper sheets of paper in said stacks in said holders to urge said upper sheets against said supporting surfaces.

12. A machine as claimed in claim 11, wherein each of said pressure means comprises a knife edge, means mounting said knife edge to extend substantially perpendicular to said predetermined direction and means biasing said knife edge towards said supporting surface, said knife edge being angled to said common plane whereby said knife edge engages only with said upper sheets of said stack.

* * * * *